US008344609B2

(12) United States Patent
Hiroike

(10) Patent No.: US 8,344,609 B2
(45) Date of Patent: Jan. 1, 2013

(54) IMAGE DISPLAY APPARATUS INCLUDING ELECTRON-EMITTING DEVICE

(75) Inventor: Taro Hiroike, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 128 days.

(21) Appl. No.: 12/969,269

(22) Filed: Dec. 15, 2010

(65) Prior Publication Data

US 2011/0148283 A1 Jun. 23, 2011

(30) Foreign Application Priority Data

Dec. 21, 2009 (WO) ..... PCT/JP2009/071243

(51) Int. Cl.
*H01J 1/62* (2006.01)

(52) U.S. Cl. ..... 313/495

(58) Field of Classification Search ..... None
See application file for complete search history.

(56) References Cited

U.S. PATENT DOCUMENTS

2005/0248257 A1 11/2005 Yoo
2009/0273270 A1 11/2009 Suzuki

FOREIGN PATENT DOCUMENTS

JP 4-137423 A 5/1992
JP 2003-16905 A 1/2003
JP 2005-294262 A 10/2005
JP 2009-272097 A 11/2009

OTHER PUBLICATIONS

Machine translation of JP2003-016905, published Jan. 17, 2003.*

* cited by examiner

*Primary Examiner* — Anh Mai
*Assistant Examiner* — Britt D Hanley
(74) *Attorney, Agent, or Firm* — Canon U.S.A., Inc. IP Division

(57) ABSTRACT

A plurality of electron-emitting devices arranged in a matrix, a row wiring that connects electron-emitting portions of electron-emitting devices arranged in the same line to one another, and a column wiring that connects gate connection members of electron-emitting devices arranged in the same column to one another are included. Each of the plurality of gates is positioned at one side of an electron-emitting portion in an arrangement direction in which the plurality of electron-emitting portions are arranged.

19 Claims, 10 Drawing Sheets

IMAGE DISPLAY APPARATUS INCLUDING ELECTRON-EMITTING DEVICE

TECHNICAL FIELD

The present invention relates to an image display apparatus that includes an electron-emitting device.

BACKGROUND ART

A type of image display apparatus that displays an image by bombarding electrons emitted from electron-emitting devices onto light-emitting members is known. When a light-emitting shape is controlled by an image display apparatus of this type so as to achieve a higher definition of a displayed image or the like, the shapes of electron beams with which the light-emitting members are irradiated need to be controlled. In Japanese Patent Laid-Open No. 04-137428, with regard to a technology for controlling the shapes of electron beams, a wiring electrode that includes projecting portions that sandwich an electron-emitting device is disclosed.

However, in the technology disclosed in Japanese Patent Laid-Open No. 04-137428, since individual electron-emitting devices require projecting portions on the wiring electrode, the structure of the display apparatus becomes complicated and an installation space corresponding to the number of the projecting portions on the wiring electrode is needed. As a result, there is a concern that the display apparatus needs to be larger.

The present invention aims to provide an image display apparatus that enables electron beams to be converged with a simple structure.

SUMMARY OF INVENTION

According to an aspect of the present invention, an apparatus that includes a rear plate configured to include a plurality of electron-emitting devices arranged in a matrix, each of which includes a plurality of electron-emitting portions arranged in a line, a cathode connection member that connects the plurality of electron-emitting portions to one another, a plurality of gates, each of which is positioned near a corresponding one of the plurality of electron-emitting portions, and a gate connection member that connects the plurality of gates to one another, a plurality of row wirings, each of which connects cathode connection members of electron-emitting devices arranged in a same row from among the plurality of electron-emitting devices to one another, and a plurality of column wirings, each of which connects gate connection members of electron-emitting devices arranged in a same column from among the plurality of electron-emitting devices to one another; and a faceplate configured to include an anode that accelerates electrons emitted from the plurality of electron-emitting devices and light-emitting members that emit light upon being bombarded with the electrons. Each of the plurality of gates is positioned at one side of an electron-emitting portion positioned near the gate in an arrangement direction in which the plurality of electron-emitting portions are arranged.

Further features of the present invention will become apparent from the following description of exemplary embodiments with reference to the attached drawings.

DESCRIPTION OF EMBODIMENTS

In the following, preferred embodiments of the present invention will be described with reference to the drawings.

Figure 1:
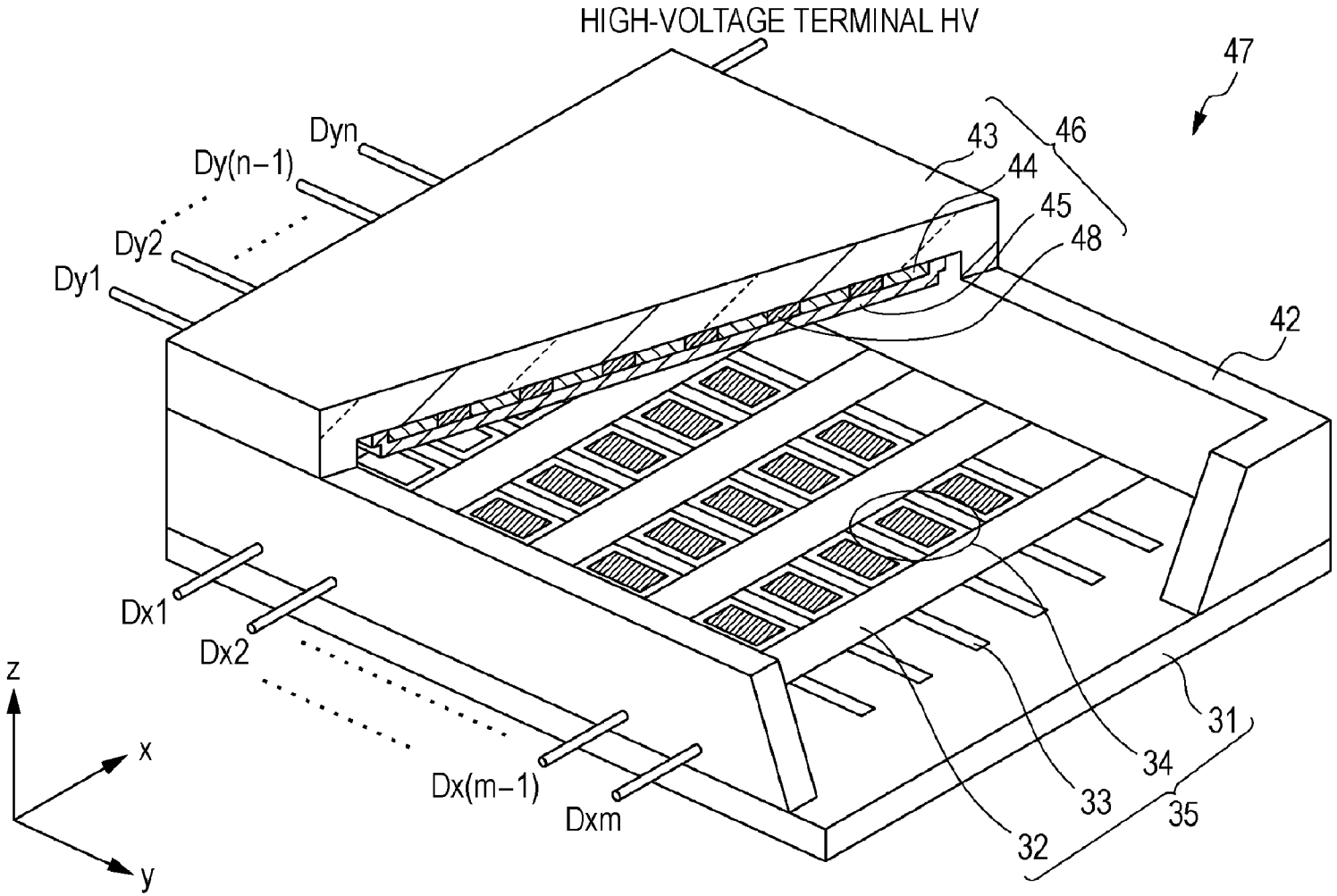
FIG. 1 is a perspective view of an image display apparatus of an embodiment.
Figure 2A:
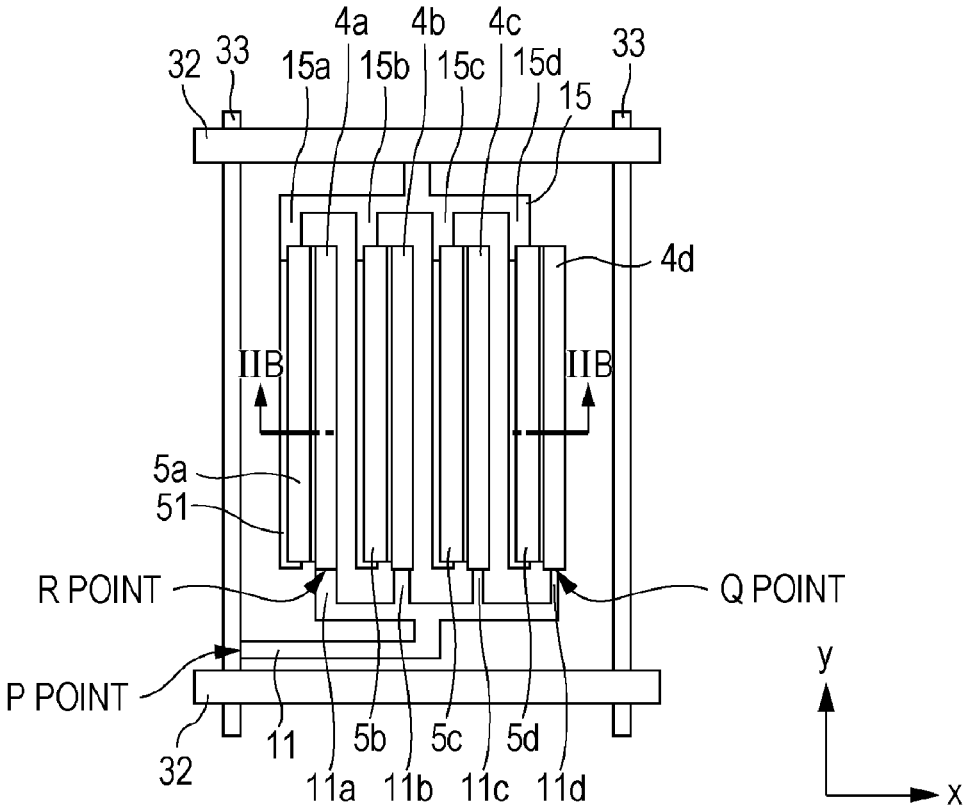
FIGS. 2A and 2B are a plan view and a cross-sectional view illustrating an example of an electron-emitting device of the embodiment.
Figure 2B:
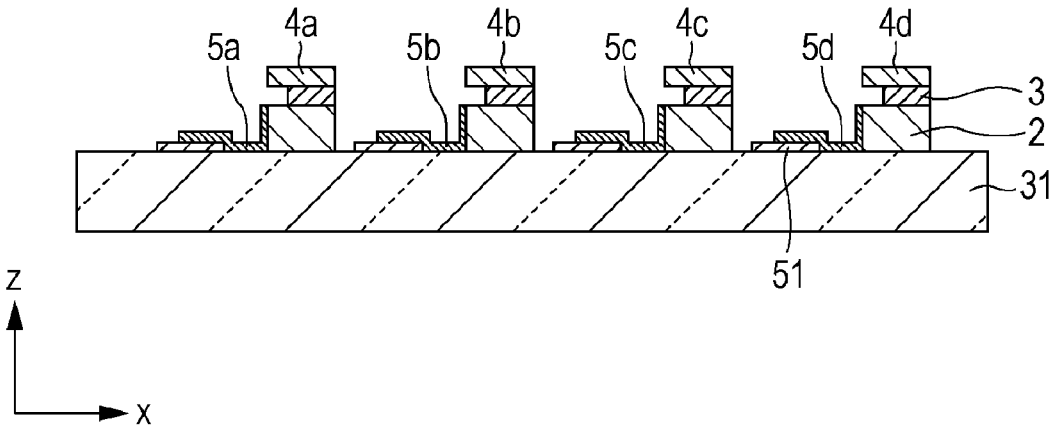

FIG. 1 is a perspective view of an image display apparatus of the present embodiment, and part of the image display apparatus has been cut away in order to show the internal structure. FIG. 2A is a partially enlarged view of one of electron-emitting devices 34 of the image display apparatus of FIG. 1. FIG. 2B is a cross-sectional view taken along line IIB-IIB of FIG. 2A.

As illustrated in FIG. 1, a faceplate 46 and a rear plate 35 are joined together by a frame 42 therebetween to form an image display apparatus 47. The faceplate 46 includes a front substrate 43 and a plurality of light-emitting members 44 and an anode 45 that are arranged on the front substrate 43. The light-emitting members 44 emit light upon being bombarded with electrons emitted from the electron-emitting devices 34 described below. The rear plate 35 includes a back substrate 31, the plurality of electron-emitting devices 34 arranged in a matrix on the back substrate 31, a plurality of row wirings 32, and a plurality of column wirings 33. As illustrated in FIG. 2A, each of the plurality of electron-emitting devices 34 includes a plurality of electron-emitting portions 5*a* to 5*d*, a cathode connection member 15 used to connect the plurality of electron-emitting portions to one another, a plurality of gates 4*a* to 4*d*, and a gate connection member 11 used to connect the plurality of gates to one another. Here, the cathode connection member 15 includes connection portions 15*a* to 15*d*, and these connection portions 15*a* to 15*d* are connected to the plurality of electron-emitting portions 5*a* to 5*d*, respectively. Similarly, the gate connection member 11 includes connection portions 11*a* to 11*d*, and these connection portions 11*a* to 11*d* are connected to the plurality of gates 4*a* to 4*d*, respectively. Here, the electron-emitting portions 5*a* to 5*d* are arranged in a line, and are arranged parallel to the X axis in the present embodiment. The gates 4*a* to 4*d* are positioned near the electron-emitting portions 5*a* to 5*d*, respectively. Each of the plurality of row wirings 32 connects, to one another, cathode connection members 15 of electron-emitting devices 34 arranged in the same row from among the plurality of electron-emitting devices 34 arranged in a matrix. Each of the plurality of column wirings 33 connects, to one another, gate connection members 11 of electron-emitting devices 34 arranged in the same column from among the plurality of electron-emitting devices 34 arranged in a matrix.

Each of the plurality of gates 4*a* to 4*d* is positioned on one side of a corresponding one of the electron-emitting portions 5*a* to 5*d*, each of which is positioned near a corresponding one of the gates, in an arrangement direction in which the plurality of electron-emitting portions are arranged. In the embodiment illustrated in FIGS. 2A and 2B, each of the gates 4*a* to 4*d* are positioned on a side (right side) of a corresponding one of the electron-emitting portions in a positive direction in the X-axis direction. That is, each of the plurality of gates 4*a* to 4*d* is positioned on the same side of a corresponding one of the electron-emitting portions 5*a* to 5*d*, each of which is positioned near a corresponding one of the gates. The resistance of the gate connection member 11 between the connection portion 11*d* of the gate connection member 11 connected to the gate 4*d*, which is positioned at one end of the plurality of electron-emitting portions in the arrangement direction, that is, at the end in the positive direction along the X axis, and a connection portion of the gate connection member 11 connected to a column wiring 33 is greater than the resistance of the gate connection member 11 between the connection portion 11*a* of the gate connection member 11 connected to the gate 4*a*, which is positioned at the other end opposite the one end, and the connection portion of the gate connection member 11 connected to the column wiring 33. More specifically, in FIG. 2A, the resistance of the gate connection member 11 between P and Q points is greater than the resistance of the gate connection member 11 between the P point and an R point. In the embodiment illustrated in FIG. 2A, the relationship between these resistances is realized by making the width (the length in the X direction) of the connection portion 11*d* of the gate connection member 11 connected to the gate 4*d* be narrower than the width (the length in the X direction) of the connection portion 11*a* of the gate connection member 11 connected to the gate 4*a*. Here, in other words, it can be said that the width of the gate connection member at a connection portion of the gate connection member connected to a gate positioned near an electron-emitting portion positioned at one end of the plurality of electron-emitting portions arranged in a line is narrower than the width of the gate connection member at a connection portion of the gate connection member connected to a gate positioned near an electron-emitting portion positioned at the other end.

Hence, the amount of deflection of an electron emitted from the electron-emitting portion 5*d* positioned at one end, in the arrangement direction, of the plurality of electron-emitting portions arranged in a line is smaller than the amount of deflection of an electron emitted from the electron-emitting portion 5*a* positioned at the other end. As a result, electron beams emitted from the electron-emitting devices 34 are converged, so that high-definition image display can be realized. This will be specifically described by using FIGS. 3 to 5D. Here, in the following description, electron-emitting portions and gates may be simply described as electron-emitting portions 5 and gates 4. These mean generic names for the above-described electron-emitting portions 5*a* to 5*d* and for the gates 4*a* to 4*d*. Unless otherwise specified, an electron-emitting portion 5 means an arbitrary electron-emitting portion from among the above-described electron-emitting portions 5*a* to 5*d*, and a gate 4 means an arbitrary gate from among the gates 4*a* to 4*d*. Here, the electron-emitting devices illustrated not only in FIGS. 2A and 2B but also in FIGS. 3 to 5D described in the following and FIGS. 6A to 8G described below are what is called vertical-type electron-emitting devices, which are formed by stacking insulating layers 2 and 3 on the back substrate 31 and by forming electron-emitting portions on side surfaces thereof and gates on top surfaces thereof. However, the present invention is not limited to vertical-type electron-emitting devices.

Figure 3:
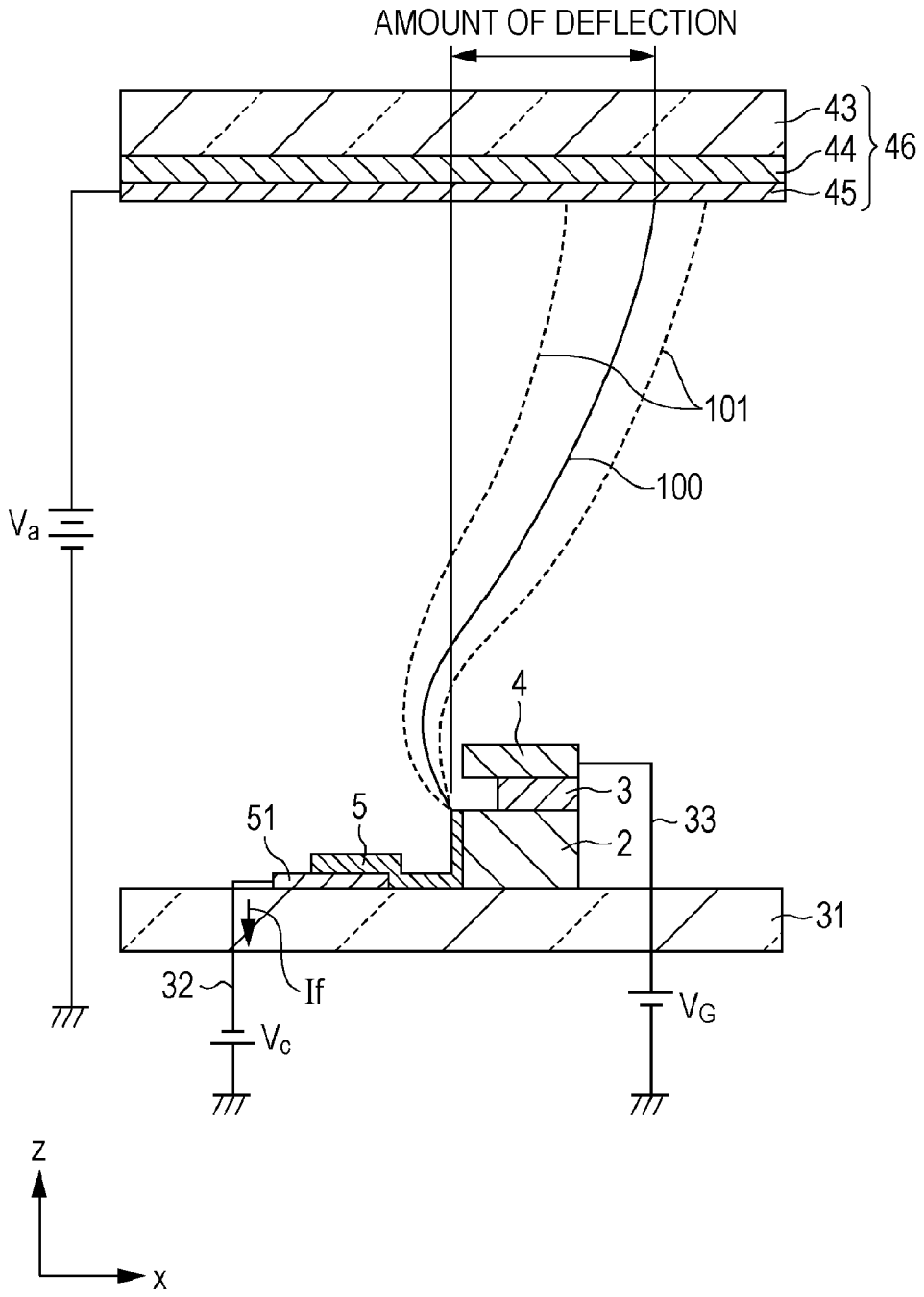
FIG. 3 is a cross-sectional view of the image display apparatus of the embodiment.
Figure 4A:
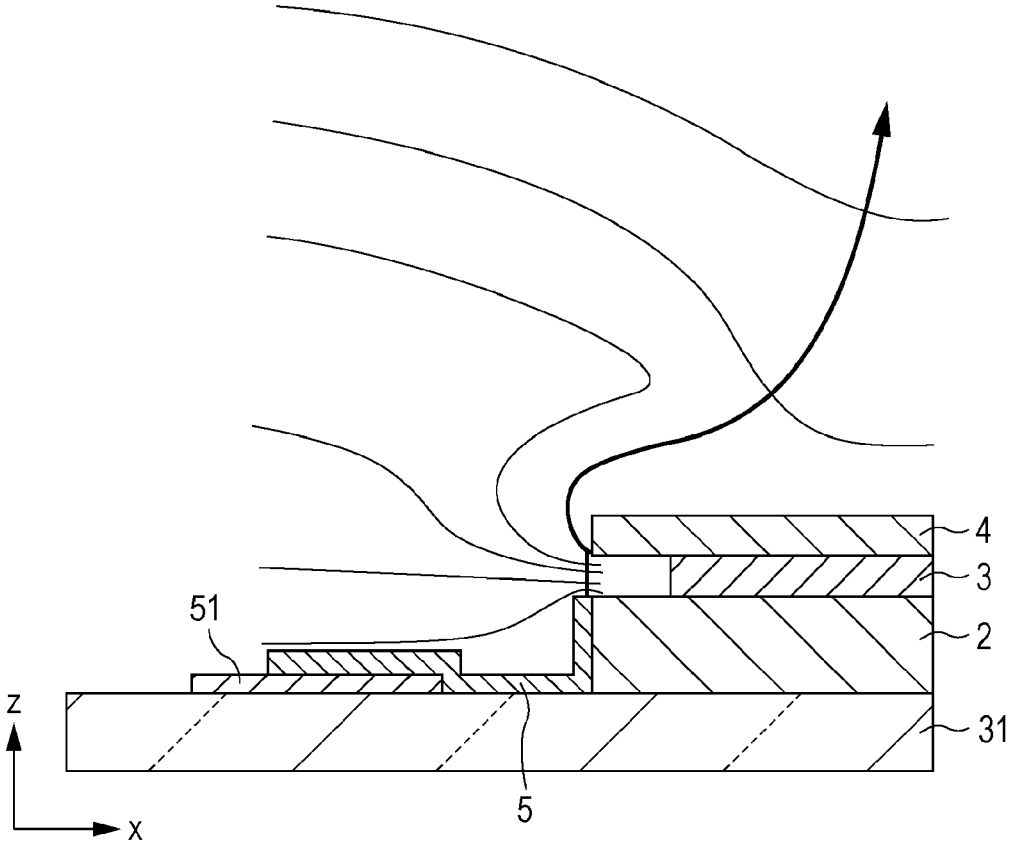
FIGS. 4A and 4B are a partially enlarged view illustrating an example of an electron-emitting portion of the embodiment and a diagram illustrating an arrival position of an electron beam and an amount of the electron beam.

FIG. 3 is a diagram illustrating an electron beam emitted from one of the electron-emitting portions 5. FIG. 4A is a partially enlarged view illustrating an electron trajectory and a potential distribution near the electron-emitting portion of FIG. 3. In FIG. 3, a solid line 100 and broken lines 101 are lines schematically illustrating a trajectory of an electron emitted from the electron-emitting portion. The solid line 100 illustrates an average trajectory of emitted electrons. The broken lines 101 are lines illustrating a range of trajectories of electrons deviating from the average trajectory from among the emitted electrons. Here, the position at which the solid line 100 meets the faceplate 46 indicates the barycentric position of an electron beam that has arrived at the faceplate, which will be specifically described below by using FIG. 4B, and the positions at which the two broken lines 101 meet the faceplate 46 indicate the positions, in the X direction, of an outer region of the electron beam that has arrived at the faceplate.

In the structures illustrated in FIGS. 3 and 4A, a gate positioned near an electron-emitting portion is positioned only on a positive side of the electron-emitting portion along the X axis, which is on one side of the electron-emitting portion. Thus, when a voltage is applied across the electron-emitting portion and the gate, as illustrated in FIG. 4A, a skew potential distribution is formed near the electron-emitting portion. As a result, an electron emitted from the electron-emitting portion travels while being deflected in the positive direction, which is one direction, in the direction in which the X axis extends in the drawing. Here, the amount of deflection of an electron is proportional to how much the potential distribution is skewed; as the potential distribution is more greatly skewed, an electron becomes more greatly deflected. Here, how much the potential distribution is skewed depends on the magnitude of a voltage applied across the electron-emitting portion and the gate; as the applied voltage becomes greater, the potential distribution is more greatly skewed.

On the other hand, the voltage applied across the electron-emitting portion and the gate depends on resistances between the row wiring 32 and column wiring 33 connected to a power source and the electron-emitting portion 5 and gate 4. As illustrated in FIG. 3, when a voltage is applied across the electron-emitting portion 5 and the gate 4 via the row wiring 32 and the column wiring 33 to cause a current If to flow through the electron-emitting portion 5, part of the current If reaches an anode as an emission electron (Ie). Here, a voltage actually applied across the electron-emitting portion 5 and the gate 4 is smaller than an output voltage (Vg−Vc) of the power source by a value obtained by multiplying the resistance between the row wiring 32 and the electron-emitting portion 5 by If and a value obtained by multiplying the resistance between the column wiring 33 and the gate 4 by If−Ie. As described above, the greater the resistance between the row wiring 32 and the electron-emitting portion 5 or the greater the resistance between the column wiring 33 and the gate 4, the smaller the voltage actually applied across the electron-emitting portion 5 and the gate 4. That is, the amount of deflection of an electron emitted from the electron-emitting portion 5 can be controlled by the resistance between the row wiring 32 and the electron-emitting portion 5 or the resistance between the column wiring 33 and the gate 4. The greater the resistance, the smaller the amount of deflection of an electron.

In this way, an electron emitted from an electron-emitting portion is deflected, and thus the barycenter of an electron beam is shifted in the positive direction along the X axis from the electron-emitting portion, as illustrated in FIG. 3. Here, the amount of deflection and the barycenter of an electron beam will be described.

Figure 4B:
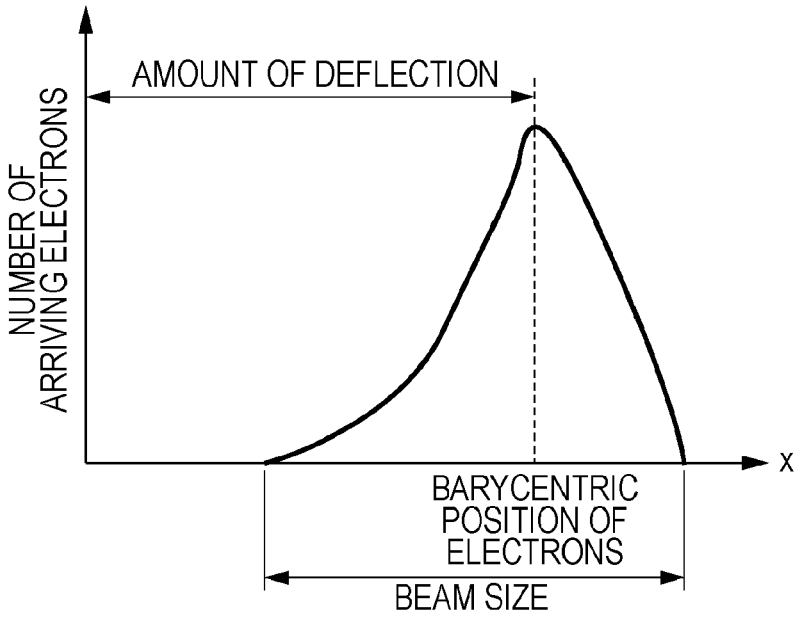

FIG. 4B is a diagram illustrating a relationship between an arrival position of an electron beam emitted from one of the electron-emitting portions 5 in the positive direction along the X axis on the faceplate 46 and the number of electrons of the electron beam. The origin of the horizontal axis indicates a position on the faceplate that lies directly above the electron-emitting portion 5. As illustrated in FIG. 4B, electrons emitted from one of the electron-emitting portions diffuse while being deflected in the positive direction along the X axis, and arrive at the faceplate 46 while spreading onto the faceplate 46. Moreover, as illustrated in FIG. 4B, the distribution of the number of arriving electrons is such that one bump is formed in the positive direction along the X axis. As described above, when the electron beam has a certain width and there is one peak in the distribution of the number of arriving electrons, the barycentric position of the electron beam is a position at which the largest number of arriving electrons are found and the distance between the barycentric position and the position on the faceplate that lies directly above the electron-emitting portion is an amount of deflection. Here, as described above, the position at which the solid line 100 meets the faceplate in FIG. 3 indicates the barycentric position based on this concept. The distance between the positions at which the two broken lines 101 meet the faceplate 46 is the same as the beam size illustrated in FIG. 4B. Next, convergence of electron beams in an electron-emitting device 34 in which electron-emitting portions whose emitted electrons are deflected are arranged in a line will be described.

FIG. 5 includes diagrams illustrating trajectories of electron beams in one of the electron-emitting devices 34 in which a plurality of prepared electron-emitting portions described above are arranged in a line and diagrams illustrating relationships between arrival positions on the faceplate 46 and the number of arriving electrons. More specifically, FIG. 5A is a diagram illustrating trajectories of electron beams emitted from the electron-emitting device of the embodiment of the present invention illustrated in FIG. 2A. FIG. 5B is a diagram illustrating a relationship between arrival positions of electrons emitted from the electron-emitting device illustrated in FIG. 5A on the faceplate and the number of arriving electrons. FIG. 5B is a diagram in which electron beams emitted from individual electron-emitting portions are summed. Here, as illustrated in FIG. 5B, when an electron beam emitted from one electron-emitting device is formed by summing the electron beams emitted from the individual electron-emitting portions, the barycenter of the electron beams (the amount of deflection) is determined by a weighted average of the electron beams emitted from the individual electron-emitting portions. Similarly to FIG. 5B and FIG. 5D described below, when there are a plurality of peaks in the distribution of the number of arriving electrons, the position of the peak positioned in the central part is the barycentric position. In the cases of FIGS. 5B and 5D, the second peak from the end in the positive direction along the X axis (the second peak from the right in the drawing) is the barycentric position. Here, when there is no peak, the center of the beams is the barycenter of the beams.

Figure 5A:
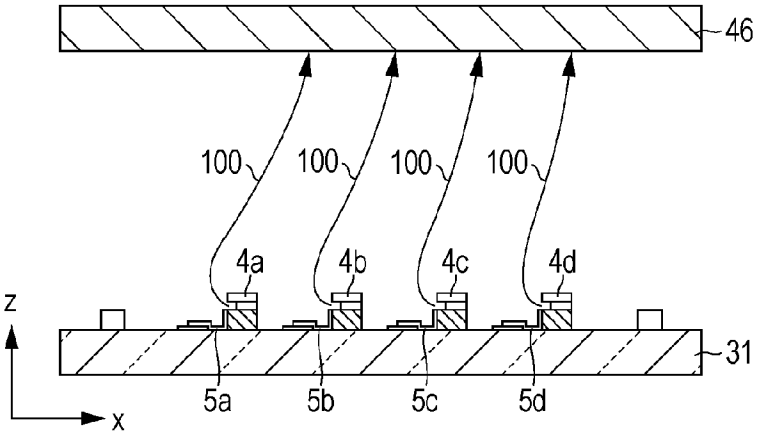
FIGS. 5A to 5D are diagrams illustrating trajectories of electrons emitted from electron-emitting devices of the embodiment and the number of arriving electrons.
Figure 5B:
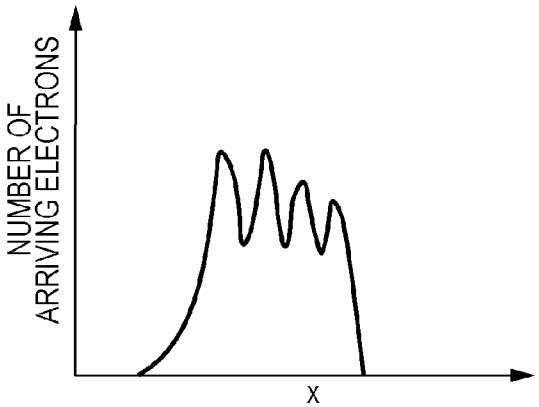
Figure 5C:
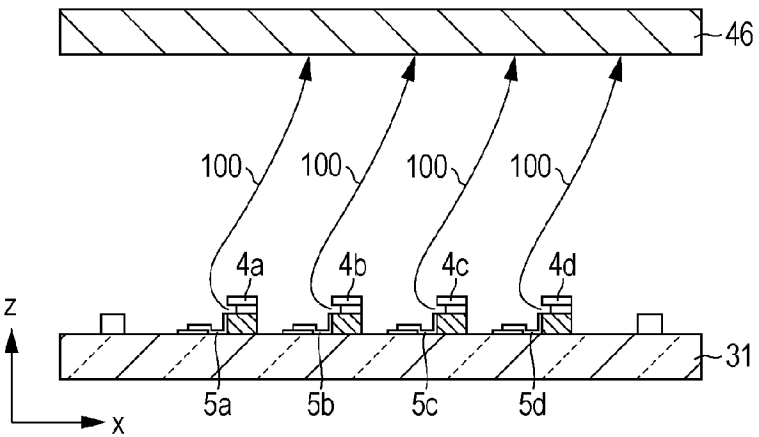
Figure 5D:
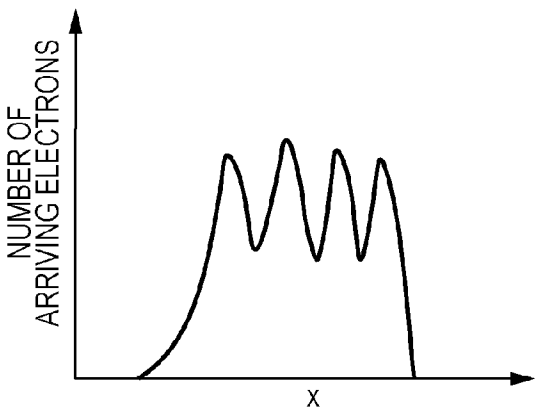
Figure 9:
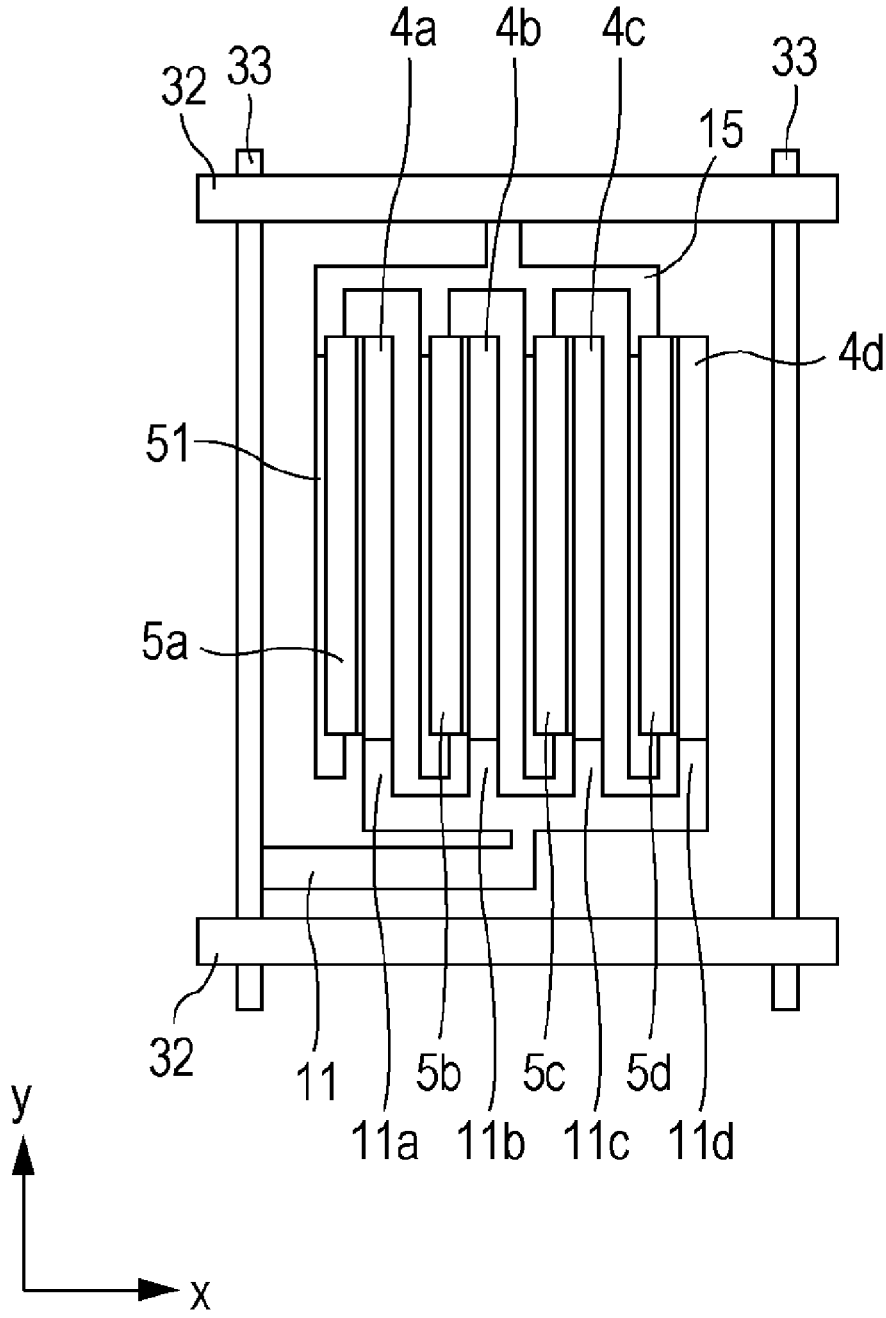
FIG. 9 is a plan view of an electron-emitting device of a comparison example.

Moreover, FIG. 5C is a diagram illustrating trajectories of electron beams emitted from an electron-emitting device illustrated in FIG. 9, which do not fall under the present invention. FIG. 5D is a diagram illustrating a relationship between arrival positions of electrons emitted from the electron-emitting device illustrated in FIG. 5C on the faceplate and the number of arriving electrons. Similarly to FIG. 5B, FIG. 5D is a diagram in which electron beams emitted from the individual electron-emitting portions are summed. Here, the electron-emitting device illustrated in FIG. 9 is the same as the electron-emitting device illustrated in FIG. 2A except that the widths of the gate connection member 11 are the same at any of the connection portions of the gate connection member 11 connected to the gates, and the resistances between the column wiring 33 and the gates are also all the same. That is, the electron-emitting device illustrated in FIG. 9 is an electron-emitting device in which the width of the gate connection member 11 at the connection portion 11*d* connected to the gate 4*d* positioned near the electron-emitting portion 5*d* positioned at the one end of the electron-emitting portions in the arrangement direction is the same as the width of the gate connection member 11 at the connection portion 11*a* connected to the gate 4*a* positioned near the electron-emitting portion 5*a* positioned at the other end. Thus, as illustrated in FIG. 5C, in the case of the electron-emitting device illustrated in FIG. 9, the same voltage is applied across all the electron-emitting portions and gates. Thus, electrons emitted from any of the electron-emitting portions are deflected by a uniform amount of deflection. Thus, as illustrated in FIG. 5D, the entire electron beams are just shifted in the positive direction along the X axis but the electron beams are not converged.

In contrast, in the electron-emitting device in the present embodiment illustrated in FIG. 2A, the resistance of the gate connection member between the column wiring 33 and the connection portion 11*d* connected to the gate 4*d* positioned at the one end (the resistance of the gate connection member between the P and Q points in FIG. 2A) is greater than the resistance of the gate connection member between the column wiring 33 and the connection portion 11*a* connected to the gate 4*a* positioned at the other end (the resistance of the gate connection member between the P and R points in FIG. 2A). Thus, in the case of the electron-emitting device illustrated in FIG. 2A, a voltage applied across the electron-emitting portion 5*d* positioned at the one end and the gate 4*d* is smaller than a voltage applied across the electron-emitting portion 5*a* positioned at the other end and the gate 4*a*. Thus, as illustrated in FIG. 5A, an electron emitted from the electron-emitting portion 5*d* positioned at the one end is not deflected, in the positive direction along the X axis, as much as an electron emitted form the electron-emitting portion 5*a* positioned at the other end. In other words, an electron emitted from the electron-emitting portion 5*a* positioned at the other end is deflected more greatly in the positive direction along the X axis than an electron emitted from the electron-emitting portion 5*d* positioned at the one end. That is, in the electron-emitting device illustrated in FIG. 2A, the electron beams are shifted in the positive direction along the X axis and are deflected so as to converge to a point.

Thus, as illustrated in FIG. 5B, the beam size becomes smaller than the beam size illustrated in FIG. 5D. That is, the electron beams are converged. As described above, in the electron-emitting device of the present embodiment, a complicated structure for converging electron beams does not have to be additionally provided around the electron-emitting device, and electron beams can be converged with a simple structure.

Figure 6B:
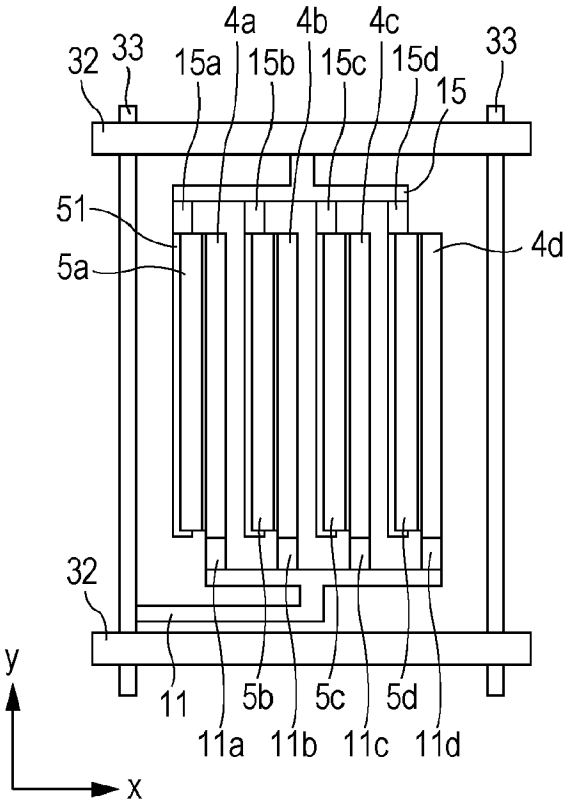
FIGS. 6A and 6B are plan views illustrating an example of an electron-emitting device of another embodiment.
Figure 6A:
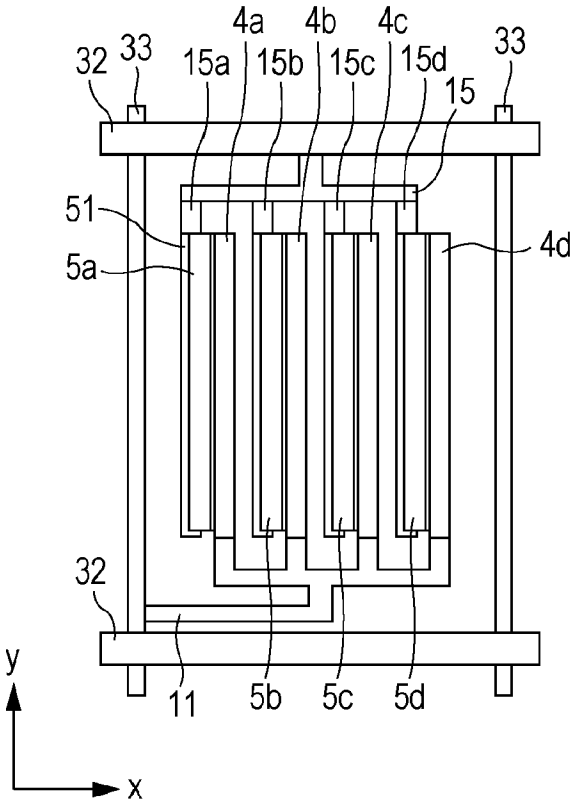

Moreover, a method for controlling a voltage applied across an electron-emitting portion positioned at one end and a gate positioned near the electron-emitting portion and a voltage applied across an electron-emitting portion positioned at the other end and a gate positioned near the electron-emitting portion is not limited to the method for controlling the resistances of the gate connection member 11 as described above. For example, as illustrated in FIG. 6A, the resistances of the cathode connection member 15 may be controlled by controlling the shapes of the connection portions 15*a* to 15*d* of the cathode connection member 15 connected to the electron-emitting portions 5*a* to 5*d*. More specifically, the width of the cathode connection member at a connection portion of the cathode connection member connected to an electron-emitting portion positioned at one end of a plurality of electron-emitting portions arranged in a line may be made narrower than the width of the cathode connection member at a connection portion of the cathode connection member connected to an electron-emitting portion positioned at the other end of the plurality of electron-emitting portions arranged in a line. Moreover, as illustrated in FIG. 6B, the resistances of both of the gate connection member 11 and the cathode connection member 15 may be controlled.

Moreover, control of a resistance of the gate connection member 11 or control of a resistance of the cathode connection member 15 is not limited to control of the width of the gate connection member 11 or control of the width of the cathode connection member 15. The thickness of the gate connection member 11 or that of the cathode connection member 15 may be controlled so as to adjust the resistance. More specifically, the thickness of the cathode connection member at a connection portion of the cathode connection member connected to an electron-emitting portion positioned at one end of a plurality of electron-emitting portions arranged in a line may be made thinner than the thickness of the cathode connection member at a connection portion connected to an electron-emitting portion positioned at the other end. The thickness of the gate connection member at a connection portion connected to a gate positioned near the electron-emitting portion positioned at the one end of the plurality of electron-emitting portions arranged in a line may be made thinner than the thickness of the gate connection member at a connection portion connected to a gate positioned near the electron-emitting portion positioned at the other end. Moreover, what is changed is not limited to the width or the thickness, and a material used may differ from connection portion to connection portion. Here, a nonlinear device such as a diode or a transistor may be used instead of a simple resistor material so as to make an applied voltage differ from another. However, in order to control the resistances more simply, it is preferable that the magnitudes of resistances be adjusted by making the shapes such as the widths and thicknesses differ from one another instead of using different materials.

Figure 7B:
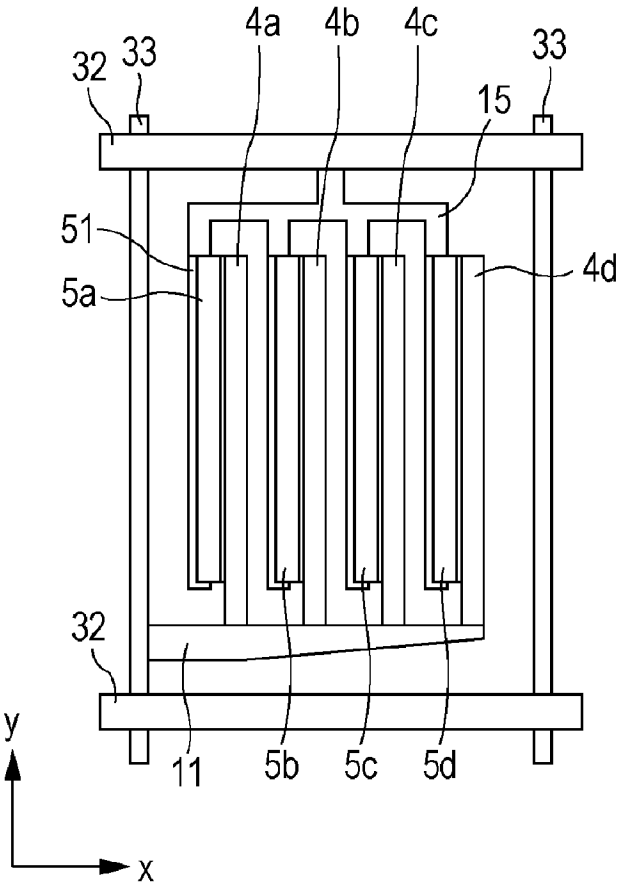
FIGS. 7A and 7B are plan views illustrating an example of an electron-emitting device of another embodiment.
Figure 7A:
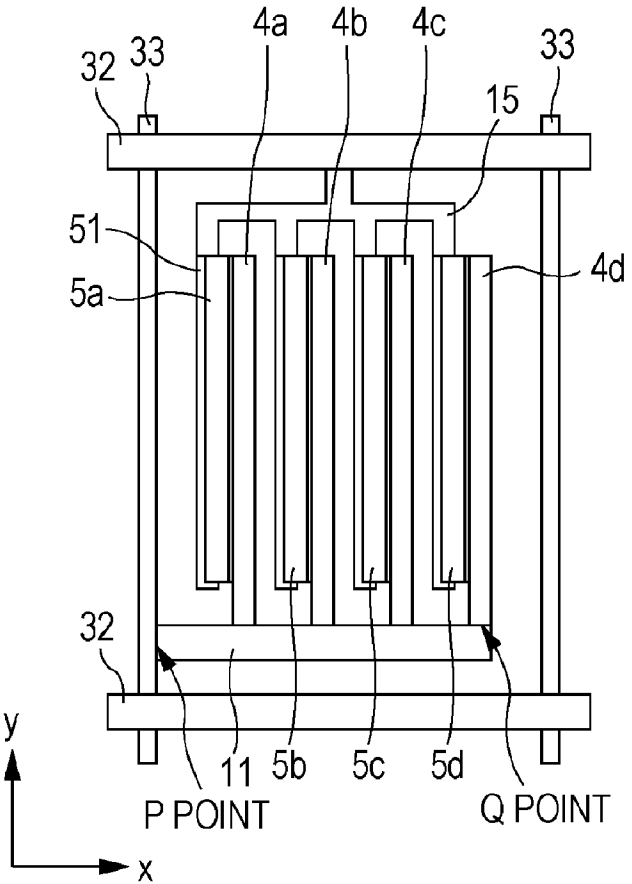

Moreover, part used to control the resistance of each connection member is not limited to a connection portion of the gate connection member 11 connected to a gate 4 or a connection portion of the cathode connection member 15 connected to an electron-emitting portion 5. As illustrated in FIG. 7A, the resistance may be adjusted in the entire gate connection member 11 by making the gate connection member 11 be formed of a resistor and by making the length between a connection portion of the gate connection member 11 connected to the gate 4*d* positioned near the electron-emitting portion 5*d* positioned at the one end and a connection portion of the gate connection member 11 connected to a column wiring 33 be longer than the length between a connection portion of the gate connection member 11 connected to the gate 4*a* positioned near the electron-emitting portion 5*a* positioned at the other end and a connection portion of the gate connection member 11 connected to the column wiring 33. More specifically, as illustrated in FIG. 7A, the gate connection member 11 may be connected to the column wiring 33 at the other end, in the arrangement direction, of the plurality of electron-emitting portions arranged in a line. As described above, the resistance of the gate connection member 11 between the connection portion of the gate connection member 11 connected to the gate 4*d* positioned at the one end and the connection portion of the gate connection member 11 connected to the column wiring 33 may be made greater than the resistance of the gate connection member 11 between the connection portion of the gate connection member 11 connected to the gate 4*a* positioned at the other end and the connection portion of the gate connection member 11 connected to the column wiring 33. As a result, similarly to the above-described other structure, a voltage applied across the electron-emitting portion 5*d* positioned at the one end, in the arrangement direction, of the plurality of electron-emitting portions arranged in a line and the gate 4*d* positioned near the electron-emitting portion 5*d* may be made smaller than a voltage applied across the electron-emitting portion 5*a* positioned at the other end and the gate 4*a* positioned near the electron-emitting portion 5*a*. Thus, similarly to the above-described other structure, electron beams can be converged. Here, adjustment of the resistances by the entire gate connection member 11 is not limited to a case in which the gate connection member 11 is formed of a resistor. As illustrated in FIG. 7B, the entire resistance may be adjusted by making the gate connection member 11 be formed of an electric conductor and by adjusting the width or thickness thereof in the direction from the other end to the one end. Moreover, in FIGS. 7A and 7B, which part of the gate connection member 11 is connected to the column wiring 33 has been described; however, the cathode connection member 15 may be connected to the row wiring 32 at the other end.

Here, the gates 4 may be constituted by a member different from a member constituting the gate connection member 11, or the gates 4 and the gate connection member 11 may be constituted by the same member. Moreover, the electron-emitting portions 5 may by constituted by a member different from a member constituting the cathode connection member 15, or the electron-emitting portions 5 and the cathode connection member 15 may be constituted by the same member. Note that since the electron-emitting portions 5 needs to satisfy various conditions such as a low work function and superior heat resistance, it is preferable that the electron-emitting portions 5 be constituted by a member different from a member that constitutes the cathode connection member 15.

Moreover, in any of the cases, as a voltage applied across the electron-emitting portion positioned at the one end and the gate positioned near the electron-emitting portion becomes smaller than a voltage applied across the electron-emitting portion positioned at the other end and the gate positioned near the electron-emitting portion, the above-described convergence effect becomes greater. This is preferable. However, when the voltage applied across the electron-emitting portion positioned at the one end and the gate positioned near the electron-emitting portion is too small, the number of emitted electrons decreases too significantly. As a result, the brightness of a displayed image may be reduced or the contrast of a displayed image may be reduced. Hence, it is preferable that the resistance of the gate connection member 11 between the column wiring 33 and the gate positioned at the one end or the resistance of the cathode connection member 15 between the row wiring 32 and the electron-emitting portion positioned at the one end be set to 30 kΩ or less. In addition, in order to obtain a sufficient convergence effect without deforming the beam shape significantly, it is preferable that the difference between the resistance of the gate connection member 11 between the column wiring 33 and the gate positioned at the one end and the resistance of the gate connection member 11 between the column wiring 33 and the gate positioned at the other end be from 2 kΩ to 20 kΩ, more preferably from 5 kΩ to 10 kΩ. Here, it is also preferable that the difference between the resistance of the cathode connection member 15 between the row wiring 32 and the electron-emitting portion positioned at the one end and the resistance of the cathode connection member 15 between the row wiring 32 and the electron-emitting portion positioned at the other end be in the above-described range.

Next, individual members included in the present embodiment will be described. Here, as described above, an image display apparatus, which has superior electron-emitting characteristics and in which what is called vertical-type electron-emitting devices are used, will be described in the present embodiment; however, the present embodiment is not limited thereto. First, members included in the rear plate 35 will be described.

It is desirable that the back substrate 31 be a substrate that has strength to mechanically support the electron-emitting devices 34, the row wirings 32, the column wirings 33, and the like, and that is resistant to dry etching, wet etching, alkalis or acids used as a developing solution or the like. Hence, as the back substrate 31, a quartz glass, a glass whose amount of impurity such as Na is reduced, a soda-lime glass, a layered product obtained by depositing a layer of $SiO_2$ on a soda-lime glass, an Si substrate, and the like by a sputtering method or the like, a ceramic such as alumina, or the like can be used. In the present embodiment, it is preferable that a glass that is highly resistant to strain such as PD200 be used.

As the insulating layers 2 and 3, a material that is resistant to a high electric field is preferable. For example, oxides such as $SiO_2$, nitrides such as $Si_3N_4$, or the like can be used. The insulating layers 2 and 3 can be formed by a general vacuum film forming method such as a sputtering method, a CVD method, a vacuum deposition method, or the like.

It is desirable that the gates 4 be composed of a material that has a high heat conductivity in addition to a good electric conductivity and has a high melting point. As such a material, metals such as Be, Mg, Ti, Zr, Hf, V, Nb, Ta, Mo, W, Al, Cu, Ni, Cr, Au, Pt, and Pd or alloy materials may be used. Moreover, carbides such as TiC, ZrC, HfC, TaC, SiC, and WC may be used. Moreover, borides such as $HfB_2$, $ZrB_2$, $CeB_6$, $YB_4$, and $GdB_4$, nitrides such as TaN, TiN, ZrN, and HfN, and semiconductors such as Si and Ge may also be used. Moreover, organic polymer materials, amorphous carbon, graphite, diamond-like carbon, and carbon, carbon compounds, and the like in which diamond is dispersed can be used. Moreover, as a forming method, a general vacuum film forming technique such as a deposition method and a sputtering method can be used.

For the electron-emitting portions 5, materials that have a good electric conductivity and emit an electric field are desirable. In general, materials that have a high melting point of 2000° C. or higher, that have a low work function of 5 eV or less, and that is resistant to formation of a chemical reaction layer composed of an oxide or the like are preferable. As such materials, metals Hf, V, Nb, Ta, Mo, W, Au, Pt, and Pd or alloy materials can be used. Moreover, carbides such as TiC, ZrC, HfC, TaC, SiC, and WC, borides such as $HfB_2$, $ZrB_2$, $CeB_6$, $YB_4$, and $GdB_4$, and nitrides such as TiN, ZrN, HfN, and TaN can be used. Furthermore, amorphous carbon, graphite, diamond-like carbon, and carbon, carbon compounds, and the like in which diamond is dispersed can also be used. Moreover, as a forming method, a general vacuum film forming technique such as a deposition method and a sputtering method can be used.

A supporting electrode 51 is an electrically conductive member positioned between an electron-emitting portion 5 and the back substrate 31 in order to ensure electric connection between the electron-emitting portion 5 and the cathode connection member 15. Materials similar to those for the above-described gates 4 can be used for the supporting electrode 51.

It is desirable that the gate connection member 11 and the cathode connection member 15 be conductors or resistors that have good properties for being processed. Materials similar to those for the above-described gates 4 or resistors such as ruthenium oxide, titanium oxide, tin oxide, ITO, and ATO can be used. Moreover, as a forming method, a general vacuum film forming technique such as a deposition method and a sputtering method, which are similar to those for the gates 4, and a printing method, an application method using a dispenser, and the like can be used.

Materials for the row wirings 32 and the column wirings 33 are not specifically limited as long as they are conductors such as metals. As a forming method, a printing method, an application method using a dispenser, and the like can be used.

Next, members included in the faceplate 46 will be described.

As the front substrate 43, a member that allows visible light to pass therethrough such as a glass may be used. In the present embodiment, a glass that is highly resistant to strain such as PD200 may be preferably used.

For the light-emitting members 44, phosphor crystal that emits light by being subjected to electron beam pumping may be used. As specific phosphor materials, for example, phosphor materials and the like that are described in "Phosphor Handbook" edited by the Phosphor Research Society (Published by Ohmsha) and those that are used in existing CRTs and the like may be used.

As the anode 45, a metal back composed of Al or the like, which is known for being used in CRTs and the like, may be used. As patterning for the anode 45, a deposition method using a mask, an etching method, or the like can be used. Since it is necessary to cause electrons to pass through the anode electrode 45 and to arrive at the light-emitting members 44, the thickness of the anode electrode 45 is set as appropriate by considering energy loss of the electrons, a set acceleration voltage (the anode voltage), and a light reflection efficiency.

Here, in the present embodiment, as illustrated in FIG. 1, as a preferred embodiment, light-shielding members 48 are included, each of which is provided between light-emitting members 44 that are next to each other.

As the light-shielding members 48, a black matrix structure known for being used in CRTs and the like may be employed. In general, the light-shielding members 48 are composed of black metal, black metal oxide, carbon, or the like. The black metal oxide may be, for example, ruthenium oxide, chromium oxide, iron oxide, nickel oxide, molybdenum oxide, cobalt oxide, copper oxide, or the like.

The outer edge of the faceplate 46 and that of the rear plate 35, which have been described above, are joined together by the frame member 42 to form the image display apparatus 47.

When an image is displayed on the image display apparatus 47 formed as described above, an acceleration voltage Va is applied via a high-voltage terminal HV and potentials are applied to a row wiring 32 and a column wiring 33 via terminals Dx and Dy in such a manner that the potential of the column wiring 33 is higher than the potential of the row wiring 32, so that a driving voltage Vf is applied to the electron-emitting device 34 and arbitrary electron-emitting devices 34 are caused to emit electrons. An electron emitted from an electron-emitting device is accelerated and collides with a light-emitting member 44. As a result, the light-emitting members 44 are selectively excited and caused to emit light, and an image is displayed.

EXAMPLES

First Example

In the following, a first example according to the present invention will be described. In the present example, an image display apparatus was created by using the rear plate 35 provided with the electron-emitting device illustrated in FIGS. 2A and 2B. Here, the faceplate and the entire structure of the image display apparatus have been described in the above-described embodiment, and thus only characterizing portions of the present example will be specifically described.

FIGS. 8A to 8G are diagrams illustrating rear-plate creation processes of the present example. Plan views are in the upper row of the diagrams and cross-sectional views taken along line C-C' in the plan views are in the lower row of the diagrams. In the following, the rear-plate creation processes are described in an orderly manner.

First, a soda-lime glass was prepared as the substrate 31. After the soda-lime grass was sufficiently washed, a $Si_3N_4$ film having a thickness of 300 nm was deposited as an insulating layer 21 by a sputtering method. Next, $SiO_2$ was deposited so as to have a thickness of 20 nm as an insulating layer 22 by a sputtering method. Thereafter, TaN was deposited so as to have a thickness of 30 nm as a conductive layer 23 [FIG. 8A].

Next, Cu was deposited so as to form a film having a thickness of 1 μm by a sputtering method. The column wirings 33 were formed by performing patterning on the formed film in a photolithography process [FIG. 8B].

Next, the entire surface was coated with a positive type photoresist by a spin coating method. Thereafter, exposure and development were performed, so that a resist pattern corresponding to gates and a gate connection member was formed. Thereafter, the photoresist on which patterning was performed was used as a mask, and the conductive layer 23, the insulating layer 22, and the insulating layer 21 are dry etched by using $CF_4$ gas, so that a layered product composed of the insulating layers 2 and 3, the gates 4, and the gate connection member 11 was formed. Here, the widths of the gates were set to 10 μm, and intervals between gates that were next to each other were set to 25 μm. Moreover, in a region of the gate connection member 11 having a length of 30 μm from the connection portions of the gate connection member 11 connected to the gates 4, the widths (the length in the X direction) of the connection portions were set to 3 μm, 12 μm, 21 μm, and 30 μm from one end (the right end of the diagram) to the other end (the left end of the diagram) [FIG. 8C].

Figure 8A:
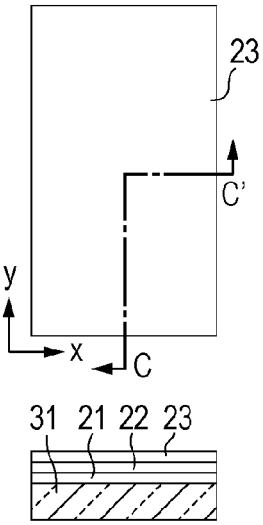
FIGS. 8A to 8G are diagrams illustrating manufacturing processes of the electron-emitting device of the embodiment.
Figure 8B:
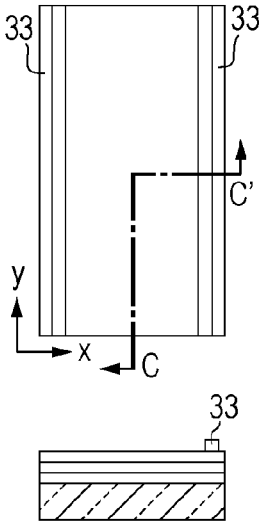
Figure 8C:
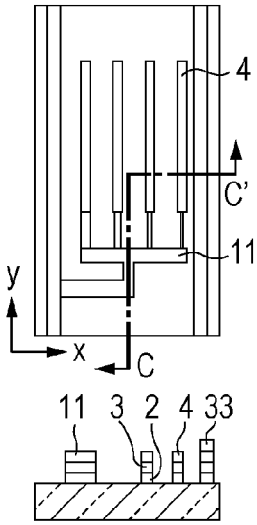
Figure 8D:
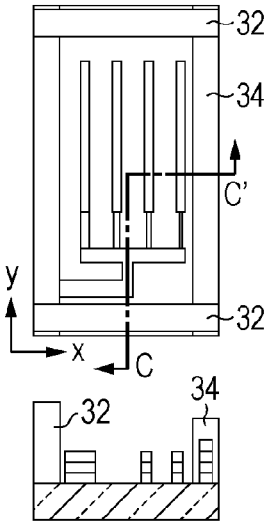
Figure 8E:
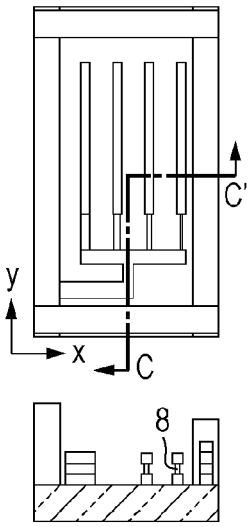
Figure 8F:
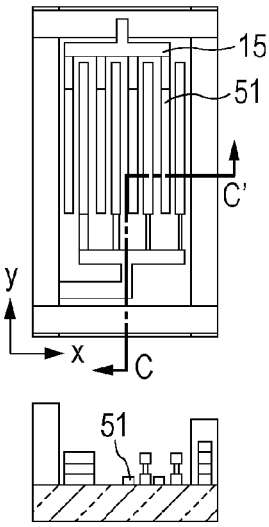
Figure 8G:
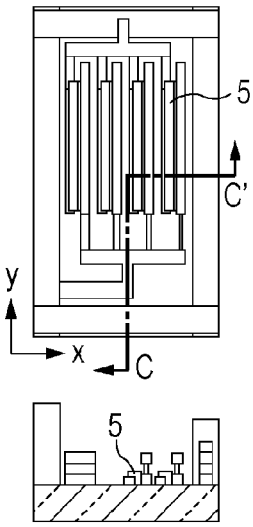

Next, an interlayer insulating layer 34 composed of $SiO_2$ was formed to have a thickness of 1 μm so as to cover part of the column wiring 33, and the row wirings 32 were formed by depositing Cu on the interlayer insulating layer 34 so as to have a thickness of 5 μm by a plating method [FIG. 8D].

Thereafter, the interlayer insulating layer 34 surrounded by the row wirings 32 that were next to each other and the column wirings 33 that were next to each other was removed by a wet etching method using an etching solution containing buffered hydrogen fluoride (BHF) (LAL100/manufactured by Stella Chemifa Corporation). The pattern of layered products composed of the insulating layers 2 and 3 and the gates 4 was exposed. Here, simultaneously, the insulating layer 3 was also selectively etched, and thus depressions 8 were formed on side surfaces of the insulating layer 3 [FIG. 8E].

Next, Mo was formed so as to have a thickness of 50 nm by a sputtering method. The supporting electrode 51 and the cathode connection member 15 were formed by performing patterning by a photolithographic method [FIG. 8F].

Next, Mo was deposited so as to have a thickness of 10 nm on a surface of the insulating layer 2 by an EB oblique deposition method from obliquely above at a 45° angle with respect to the surface of the insulating layer 2. Next, a resist pattern was formed by a photolithographic method and patterning was performed on Mo by dry etching Mo by using $CF_4$ gas, so that electron-emitting portions 5 were formed [FIG. 8G].

The image display apparatus 47 illustrated in FIG. 1 was created by using the rear plate 35 created as described above and illustrated in FIGS. 2A and 2B. Here, a gap between the rear plate 35 and the faceplate 46 was set to 2 mm. Here, the resistances of the gate connection member 11 between the connection portion of the gate connection member 11 connected to the column wiring 33 and the connection portions 11*a* to 11*d* of the gate connection member 11 connected to the gates 4*a* to 4*d*, respectively, were measured by an impedance analyzer (4294A manufactured by Agilent) and were 3000Ω, 750Ω, 430Ω, and 300Ω, respectively.

Comparison Example

Next, as a comparison example, an image display apparatus was manufactured by using a rear plate equipped with an electron-emitting device having the structure illustrated in FIG. 9. The electron-emitting device in the present comparison example has a structure similar to that of the first example except that all the widths of the connection portions 11*a* to 11*d* of the gate connection member 11 connected to the gates 4*a* to 4*d* are equal. A manufacturing method is also similar to that of the first example. Thus, description thereof will be omitted. Here, the resistances of the gate connection member 11 between the connection portion of the gate connection member 11 connected to the column wiring 33 and the connection portions 11*a* to 11*d* of the gate connection member 11 connected to the individual gates 4*a* to 4*d* were measured by the impedance analyzer (4294A manufactured by Agilent) and were all 300Ω.

Evaluation Result

In the image display apparatus manufactured as described above, a voltage was applied between the cathodes 5 and the gates 4 via individual wirings. More specifically, a potential of +100 V was applied to the column wiring 33 and a pulse potential of −10 V was applied to the row wiring 32. Moreover, simultaneously, a direct current high voltage of 12 kV was applied to the metal back 45 of the faceplate 46. When the image display apparatus was driven under these drive conditions, the amount of deflection of an electron beam was 95 μm in the present example. Moreover, the beam size (the width of a beam in the x direction) was 115 μm. In contrast, the amount of deflection of an electron beam was 102 μm in the comparison example and the beam size was 121 μm. As described above, converged electron beams can be provided by using the structure of the present example.

Second Example

As a second example of the present invention, an electron-emitting device having a structure illustrated in FIG. 7A was manufactured.

Differences from the first example are that, as illustrated in FIG. 7A, the shape of the gate connection member 11 is changed to a rectangle, the width thereof (the length in the Y direction) is made to be sufficiently narrow, 3 μm, and the gate connection member 11 is made to function as a resistor by making the thickness thereof be sufficiently thin, 10 nm. The gate connection member 11 was connected to the column wiring 33 at the other end of the gate connection member 11 (an end in a direction opposite to the positive direction (in the negative direction) along the X axis) in such a manner that the length of the gate connection member 11 between the connection portion of the gate connection member 11 connected to the gate 4*d* positioned near the electron-emitting portion 5*d* positioned at the one end and the connection portion of the gate connection member 11 connected to the column wiring 33 was longer than the length of the gate connection member 11 between the connection portion of the gate connection member 11 connected to the gate 4*a* positioned near the electron-emitting portion 5*a* positioned at the other end and the connection portion of the gate connection member 11 connected to the column wiring 33. Except for this, the structure of the second example was made to be similar to that of the first example. Here, the resistance of the gate connection member 11 between the connection portion of the gate connection member 11 connected to the column wiring 33 and the connection portion of the gate connection member 11 connected to the gate 4*a* (the resistance of the gate connection member 11 between the P and R points) was set to 600Ω, and the resistance of the gate connection member 11 between the connection portion of the gate connection member 11 connected to the column wiring 33 and the connection portion of the gate connection member 11 connected to the gate 4*d* (the resistance of the gate connection member 11 between the P and Q points) was set to 5.6Ω. Here, a method of measuring the resistances is similar to that of the first example.

Second Comparison Example

Figure 10B:
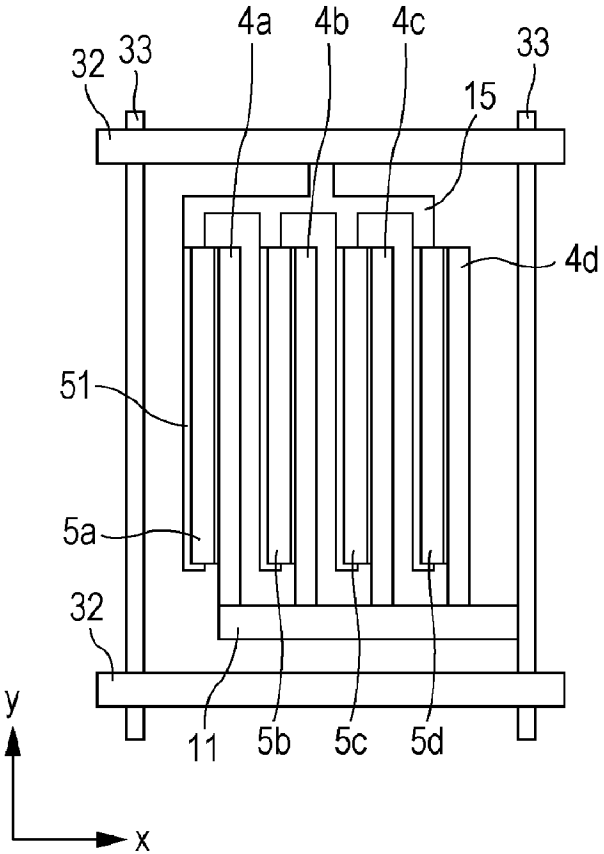
FIGS. 10A and 10B are plan views of electron-emitting devices of another comparison example.
Figure 10A:
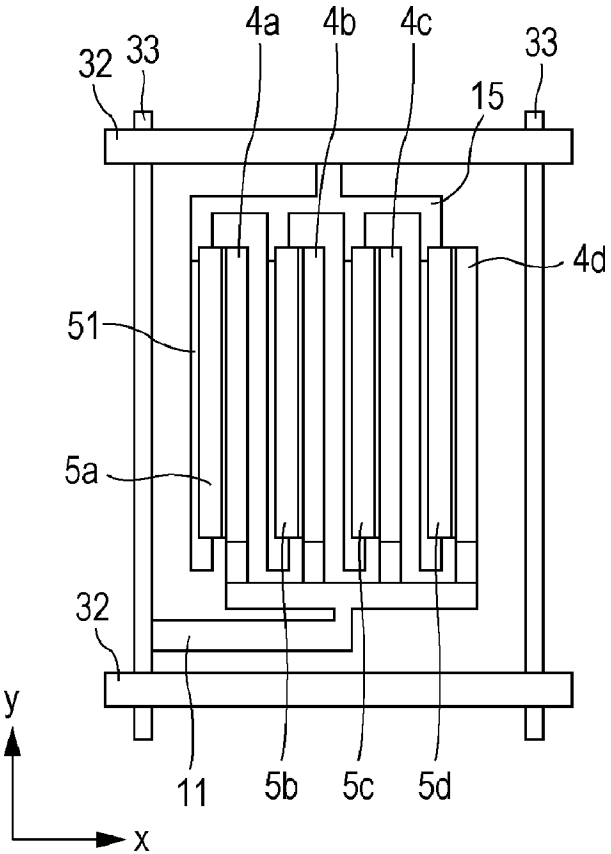

As a second comparison example, electron-emitting devices having structures illustrated in FIGS. 10A and 10B were manufactured. With respect to the structure of FIG. 10A, a difference from the second example is that the length of the gate connection member 11 between the connection portion of the gate connection member 11 connected to the gate 4*d* and the connection portion of the gate connection member 11 connected to the column wiring 33 is set to be the same as the length of the gate connection member 11 between the connection portion of the gate connection member 11 connected to the gate 4*a* and the connection portion of the gate connection member 11 connected to the column wiring 33 (a comparison example 2-1: FIG. 10A). Here, both of the resistances of the gate connection member 11 between the connection portion of the gate connection member 11 connected to the column wiring 33 and the connection portions of the gate connection member 11 connected to the individual gates 4*a* and 4*d* were 2.2Ω. With respect to the structure of FIG. 10B, a difference from the second example is that the gate connection member 11 is connected to the column wiring 33 at one end of the gate connection member 11 (an end in the positive direction along the X axis) in the arrangement direction in which the electron-emitting portions 5*a* to 5*d* are arranged, which is a deflection direction, in such a manner that the length of the gate connection member 11 between the connection portion of the gate connection member 11 connected to the gate 4*d* and the connection portion of the gate connection member 11 connected to the column wiring 33 is shorter than the length of the gate connection member 11 between the connection portion of the gate connection member 11 connected to the gate 4*a* and the connection portion of the gate connection member 11 connected to the column wiring 33 (a comparison example 2-2: FIG. 10B). The resistance of the gate connection member 11 between the connection portion of the gate connection member 11 connected to the column wiring 33 and the connection portion of the gate connection member 11 connected to the gate 4*d* was set to 600Ω, and the resistance of the gate connection member 11 between the connection portion of the gate connection member 11 connected to the column wiring 33 and the connection portion of the gate connection member 11 connected to the gate 4*a* was set to 5.6Ω. Here, except for this point, either of the comparison examples has a structure similar to that of the second example.

Evaluation Result

The manufactured image display apparatus was driven under similar conditions of the first example, and the amounts of deflection of obtained electron beams and the sizes of obtained electron beams were compared. As a result, the amount of deflection of an electron beam was 97 μm in the second example. The beam size was 117 μm. In contrast, the amount of beam deflection was 103 μm in the comparison example 2-1 and the amount of deflection was 113 μm in the comparison example 2-2. Moreover, the beam size was 122 μm in the comparison example 2-1 and 135 μm in the comparison example 2-2. Hence, converged electron beams were obtained by using the structure of the present example.

According to the present invention, an image display apparatus that enables electron beams to be converged with a simple structure can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/071243, filed Dec. 21, 2009, which is hereby incorporated by reference herein in its entirety.

REFERENCE SIGNS LIST

4 gate
5 electron-emitting portion
11 gate connection member
15 cathode connection member
32 row wiring
33 column wiring
34 electron-emitting device
35 rear plate
44 light-emitting member
45 anode
46 faceplate
47 image display apparatus

What is claimed is:

1. An apparatus comprising:

a rear plate configured to include a plurality of electron-emitting devices arranged in a matrix, each of which includes a plurality of electron-emitting portions arranged in a line, a cathode connection member that connects the plurality of electron-emitting portions to one another, a plurality of gates, each of which is positioned near a corresponding one of the plurality of electron-emitting portions, and a gate connection member that connects the plurality of gates to one another, a plurality of row wirings, each of which connects cathode connection members of electron-emitting devices arranged in a same row from among the plurality of electron-emitting devices to one another, and a plurality of column wirings, each of which connects gate connection members of electron-emitting devices arranged in the a column from among the plurality of electron-emitting devices to one another; and a faceplate configured to include an anode that accelerates electrons emitted from the plurality of electron-emitting devices and light-emitting members that emit light upon being bombarded with the electrons, wherein each of the plurality of gates is positioned at one side of an electron-emitting portion positioned near the gate in an arrangement direction in which the plurality of electron-emitting portions are arranged, and wherein a resistance of the gate connection member between a connection portion of the gate connection member connected to a gate positioned at the one end in the arrangement direction and a connection portion of the gate connection member connected to a column wiring is greater than a resistance of the gate connection member between a connection portion of the gate connection member connected to a gate positioned at the other end, which is opposite the one end.

2. The apparatus according to claim 1, wherein the connection portion of the gate connection member connected to the column wiring, or a resistance of the cathode connection member between a connection portion of the cathode connection member connected to an electron-emitting portion positioned at the one end and a connection portion of the cathode connection member connected to a row wiring is greater than a resistance of the cathode connection member between a connection portion of the cathode connection member connected to an electron-emitting portion positioned at the other end and the connection portion of the cathode connection member connected to the row wiring.

3. The apparatus according to claim 2, wherein the resistance of the gate connection member between the connection portion of the gate connection member connected to the gate positioned at the one end and the connection portion of the gate connection member connected to the column wiring is greater than the resistance of the gate connection member between the connection portion of the gate connection member connected to the gate positioned at the other end and the connection portion of the gate connection member connected to the column wiring.

4. The apparatus according to claim 3, wherein a width of the connection portion of the gate connection member connected to the gate positioned at the one end is narrower than a width of the connection portion of the gate connection member connected to the gate positioned at the other end.

5. The apparatus according to claim 2, wherein the resistance of the cathode connection member between the connection portion of the cathode connection member connected to the electron-emitting portion positioned at the one end and the connection portion of the cathode connection member connected to the row wiring is greater than the resistance of the cathode connection member between the connection portion of the cathode connection member connected to the electron-emitting portion positioned at the other end and the connection portion of the cathode connection member connected to the row wiring.

6. The apparatus according to claim 5, wherein a width of the connection portion of the cathode connection member connected to the electron-emitting portion positioned at the one end is narrower than a width of the connection portion of the cathode connection member connected to the electron-emitting portion positioned at the other end.

7. The apparatus according to claim 2, wherein the resistance of the gate connection member between the connection portion of the gate connection member connected to the gate positioned at the one end and the connection portion of the gate connection member connected to the column wiring is greater than the resistance of the gate connection member between the connection portion of the gate connection member connected to the gate positioned at the other end and the connection portion of the gate connection member connected to the column wiring.

8. The apparatus according to claim 7, wherein a thickness of the connection portion of the gate connection member connected to the gate positioned at the one end is smaller than a thickness of the connection portion of the gate connection member connected to the gate positioned at the other end.

9. The apparatus according to claim 2, wherein the resistance of the cathode connection member between the connection portion of the cathode connection member connected to the electron-emitting portion positioned at the one end and the connection portion of the cathode connection member connected to the row wiring is greater than the resistance of the cathode connection member between the connection portion of the cathode connection member connected to the electron-emitting portion positioned at the other end and the connection portion of the cathode connection member connected to the row wiring.

10. The apparatus according to claim 9, wherein a thickness of the connection portion of the cathode connection member connected to the electron-emitting portion positioned at the one end is smaller than a thickness of the connection portion of the cathode connection member connected to the electron-emitting portion positioned at the other end.

11. The apparatus according to claim 2, wherein the gate connection member is a resistor, the resistance of the gate connection member between the connection portion of the gate connection member connected to the gate positioned at the one end and the connection portion of the gate connection member connected to the column wiring is greater than the resistance of the gate connection member between the connection portion of the gate connection member connected to the gate positioned at the other end and the connection portion of the gate connection member connected to the column wiring.

12. The apparatus according to claim 11, wherein a length of the gate connection member between the connection portion of the gate connection member connected to the gate positioned at the one end and the connection portion of the gate connection member connected to the column wiring is larger than a length of the gate connection member between the connection portion of the gate connection member connected to the gate positioned at the other end and the connection portion of the gate connection member connected to the column wiring.

13. The apparatus according to claim 2, wherein the cathode connection member is a resistor, the resistance of the cathode connection member between the connection portion of the cathode connection member connected to the electron-emitting portion positioned at the one end and the connection portion of the cathode connection member connected to the row wiring is greater than the resistance of the cathode connection member between the connection portion of the cathode connection member connected to the electron-emitting portion positioned at the other end and the connection portion of the cathode connection member connected to the row wiring.

14. The apparatus according to claim 13, wherein a length of the cathode connection member between the connection portion of the cathode connection member connected to the electron-emitting portion positioned at the one end and the connection portion of the cathode connection member connected to the row wiring is larger than a length of the cathode connection member between the connection portion of the cathode connection member connected to the electron-emitting portion positioned at the other end and the connection portion of the cathode connection member connected to the row wiring.

15. An apparatus comprising:

a rear plate configured to include a plurality of electron-emitting devices arranged in a matrix, each of which includes a plurality of electron-emitting portions arranged in a line, a cathode connection member that connects the plurality of electron-emitting portions to one another, a plurality of gates, each of which is positioned near a corresponding one of the plurality of electron-emitting portions, and a gate connection member that connects the plurality of gates to one another, a plurality of row wirings, each of which connects cathode connection members of electron-emitting devices arranged in the a row from among the plurality of electron-emitting devices to one another, and a plurality of column wirings, each of which connects gate connection members of electron-emitting devices arranged in a same column from among the plurality of electron-emitting devices to one another; and a faceplate configured to include an anode that accelerates electrons emitted from the plurality of electron-emitting devices and light-emitting members that emit light upon being bombarded with the electrons, wherein each of the plurality of gates is positioned at one side of an electron-emitting portion positioned near the gate in an arrangement direction in which the plurality of electron-emitting portions are arranged, and a voltage applied across an electron-emitting portion positioned at one end, in the arrangement direction, of the plurality of electron-emitting portions that are arranged in a line and a gate positioned near the electron-emitting portion is smaller than a voltage applied across an electron-emitting portion positioned at the other end, which is opposite the one end, and a gate positioned near the electron-emitting portion.

16. An apparatus comprising:

a rear plate configured to include a plurality of electron-emitting devices arranged in a matrix, each of which includes a plurality of electron-emitting portions arranged in a line, a cathode connection member that connects the plurality of electron-emitting portions to one another, a plurality of gates, each of which is positioned near a corresponding one of the plurality of electron-emitting portions, and a gate connection member that connects the plurality of gates to one another, a plurality of row wirings, each of which connects cathode connection members of electron-emitting devices arranged in a same row from among the plurality of electron-emitting devices to one another, and a plurality of column wirings, each of which connects gate connection members of electron-emitting devices arranged in the a column from among the plurality of electron-emitting devices to one another; and a faceplate configured to include an anode that accelerates electrons emitted from the plurality of electron-emitting devices and light-emitting members that emit light upon being bombarded with the electrons, wherein each of the plurality of gates is positioned at one side of an electron-emitting portion positioned near the gate in an arrangement direction in which the plurality of electron-emitting portions are arranged, wherein a voltage applied across an electron-emitting portion positioned at one end, in the arrangement direction, of the plurality of electron-emitting portions that are arranged in a line and a gate positioned near the electron-emitting portion is smaller than a voltage applied across an electron-emitting portion positioned at the other end, which is opposite the one end, and a gate positioned near the electron-emitting portion.

17. The apparatus according to claim 16, wherein the connection portion of the gate connection member connected to the column wiring, or a resistance of the cathode connection member between a connection portion of the cathode connection member connected to an electron-emitting portion positioned at the one end and a connection portion of the cathode connection member connected to a row wiring is greater than a resistance of the cathode connection member between a connection portion of the cathode connection member connected to an electron-emitting portion positioned at the other end and the connection portion of the cathode connection member connected to the row wiring.

18. The apparatus according to claim 17, wherein the resistance of the gate connection member between the connection portion of the gate connection member connected to the gate positioned at the one end and the connection portion of the gate connection member connected to the column wiring is greater than the resistance of the gate connection member between the connection portion of the gate connection member connected to the gate positioned at the other end and the connection portion of the gate connection member connected to the column wiring.

19. The apparatus according to claim 18, wherein a width of the connection portion of the gate connection member connected to the gate positioned at the one end is narrower than a width of the connection portion of the gate connection member connected to the gate positioned at the other end.

* * * * *